United States Patent [19]

Aoyama

[11] Patent Number: 4,830,378

[45] Date of Patent: May 16, 1989

[54] GOLF BALL WITH UNIFORM LAND CONFIGURATION

[75] Inventor: Steven Aoyama, Glendale Heights, Ill.

[73] Assignee: Wilson Sporting Goods Co., River Grove, Ill.

[21] Appl. No.: 7,503

[22] Filed: Jan. 28, 1987

[51] Int. Cl.[4] ..... A63B 37/12

[52] U.S. Cl. ..... 273/232

[58] Field of Search ..... 273/235 R, 232

[56] References Cited

U.S. PATENT DOCUMENTS 878,254 2/1908 Taylor ..... 273/232
4,090,716 5/1978 Martin et al. ..... 273/232
4,560,168 12/1985 Aoyama ..... 273/235 R

FOREIGN PATENT DOCUMENTS 377354 7/1932 United Kingdom ..... 273/232
2103939 2/1983 United Kingdom ..... 273/232

*Primary Examiner*—George J. Marlo

[57] ABSTRACT

A golf ball having an outer spherical surface and at least 320 dimples formed in the outer surface to provide land areas on the outer surface which surround the dimples. Each of the dimples has a triangular periphery at the ball's outer surface provided by three sides and three flat surfaces which extend inwardly from the outer surface. The angle between each of the flat surfaces and a tangent to the ball's outer surface at the intersection with the flat surface is from 14° to 26°. Each side of each dimple extends parallel to at least a portion of the side of an adjacent dimple. The distance between the parallel sides of adjacent dimples is constant over the outer spherical surface. The total land area is no greater than 20% of a sphere which circumscribes the ball's outer spherical surface.

5 Claims, 9 Drawing Sheets

| DIMP.# | TYPE | VERT.∠ | HORIZ.∠ | ROT.∠ |
|---|---|---|---|---|
| 1 | D | 80° 10° | 36° 0° | 0° 0° |
| 2 | C | 65 29 | 13 46 | 24 5 |
| 3 | D | 73 16 | 36 0 | 180 0 |
| 4 | -C | 65 29 | 58 14 | -24 5 |
| 5 | -C | 50 7 | 8 52 | -136 31 |
| 6 | C | 34 21 | 63 8 | -136 27 |
| 7 | D | 39 33 | 6 59 | 140 59 |
| 8 | D | 37 2 | 12 41 | -42 48 |
| 9 | C | 37 2 | 26 14 | 131 48 |
| 10 | -C | 37 2 | 45 46 | -131 48 |
| 11 | D | 39° 33° | 59° 19° | 42° 59° |
| 12 | D | 34 21 | 65 -10 | 140 27 |
| 13 | D | 23 10 | 10 0 | 67 43 |
| 14 | D | 20 24 | 17 21 | -114 49 |
| 15 | -C | 25 44 | 27 39 | 57 54 |
| 16 | C | 25 44 | 44 0 | 57 54 |
| 17 | D | 20 24 | 55 50 | 114 50 |
| 18 | D | 23 10 | 61 43 | -67 43 |
| 19 | D | 16 44 | 72 0 | -0 0 |
| 20 | C | 9 38 | 18 44 | 67 55 |
| 21 | -C | 9° 38° | 53° 16° | -67° 55° |
| 22 | C | 3 38 | 62 57 | 4 16 |
| 23 | D | 9 50 | 72 0 | 180 0 |
| 24 | -C | 3 38 | 81 3 | -4 16 |
| 25 | F | 57 34 | 13 23 | 78 39 |
| 26 | F | 55 43 | 25 0 | -111 4 |
| 27 | F | 59 38 | 36 0 | 180 0 |
| 28 | F | 55 43 | 47 0 | 111 4 |
| 29 | F | 57 34 | 58 37 | -78 39 |
| 30 | E | 48 44 | 26 47 | -52 52 |
| 31 | F | 45° 30° | 36° 0° | 0° 0° |
| 32 | E | 48 44 | 45 13 | 52 52 |
| 33 | F | 38 51 | 36 0 | 180 0 |
| 34 | E | 24 35 | 36 0 | 0 0 |
| 35 | F | 14 15 | 29 45 | -118 38 |
| 36 | E | 17 56 | 36 0 | 180 0 |
| 37 | F | 14 15 | 42 15 | 118 38 |
| 38 | E | 3 44 | 24 4 | 121 31 |
| 39 | F | 7 12 | 29 47 | -59 2 |
| 40 | E | 3 48 | 36 0 | 0 0 |
| 41 | F | 7° 12° | 42° 13° | 59° 1° |
| 42 | F | 3 44 | 47 56 | -121 31 |

| DIMPLE TYPE | R | X | Y | Z |
|---|---|---|---|---|
| C | .1238 | 69°3' | 57°36' | 53°21' |
| -C | .1238 | 69°3' | 53°21' | 57°36' |
| D | .1291 | 71°13' | 54°24' | 54°24' |
| E | .0846 | 56°12' | 61°54' | 61°54' |
| F | .0882 | 63°2' | 58°29' | 58°29' |

GOLF BALL WITH UNIFORM LAND CONFIGURATION

BACKGROUND

This invention relates to golf balls, and, more particularly, to a golf ball which has a uniform land configuration.

A golf ball typically includes an outer spherical surface and depressions or dimples in the outer surface. The portions of the outer surface between the dimples are called lands. The dimples create air turbulence as the ball moves through the air. Turbulence and aerodynamic drag are related by a complicated relationship, and the dimples are intended to create the appropriate amount of turbulence which will optimally reduce the aerodynamic drag.

The aerodynamic design of golf balls has historically concentrated on the shape, size, and arrangement of the dimples. In general, little or no attention was paid to the size and shape of the spaces or lands between the dimples. The natural tendency is to view the golf ball as a 1.68 inch diameter sphere with depressions on the surface.

However, the air flow over the surface does not have such a perceptual bias. The air flow "sees" only a textured surface and has no special regard for whether the texture is provided by a large sphere with depressions in the surface or a smaller sphere with projections on the surface. In fact, the contours of the raised areas between the dimples, i.e., the lands, may have a greater effect on air flow than the shape of the dimples.

If there is an optimal land width, it is not being exploited on conventional balls with dimples which have a circular periphery. Circular dimples do not fit together, and the spaces between circular dimples are not constant. Also, the cross section of the lands between circular dimples is not constant but changes continuously around the periphery of the dimple.

SUMMARY OF THE INVENTION

The objective of the invention is to optimize the lands rather than the dimples. A uniform land configuration is obtained by using polygonal dimples which can fit together. The width and cross section of the land areas are constant throughout the outer surface of the ball except where adjacent lands intersect. The preferred embodiment uses triangular dimples. Each side of each dimple extends parallel to at least a portion of the side of an adjacent dimple, and the distance between the parallel sides is constant.

DESCRIPTION OF THE DRAWING

The invention will be explained in conjunction with an illustrative embodiment shown in the accompanying drawing, in which.

DESCRIPTION OF SPECIFIC EMBODIMENTS

The numeral 50 designates generally a golf ball having an outer spherical surface 51 and a plurality of depressions or dimples 52 in the outer surface. The golf ball can be formed in accordance with conventional and well known techniques. For example, the ball can have a three-piece construction with a core, a layer of windings of elastic thread, and a cover; a two-piece construction with a molded core and a cover; or other types of construction. The cover can be made by any convenient procedure, e.g., by compression molding or injection molding, and the cover material can be balata, Surlyn, or other material.

The portions of the outer spherical surface 51 between the dimples 52 are referred to as lands. In order to obtain lands which have substantially constant width and cross section, each dimple should have a polygonal periphery where the dimple intersects the outer surface. A polygonal shape enables the dimples to fit together so that the width between adjacent dimples is uniform throughout the surface of the ball.

It will be understood by those skilled in the art that, since the surface of a golf ball is spherical, a polygonal shape such as a triangle is not a true polygon with straight sides. Rather, the sides of the polygon curve over the spherical surface along arcs of circles. As used herein, planar terms such as "polygon," "triangle," "straight" sides of polygons, and "flat" surfaces refer to the projection of the three-dimensional surface onto a planar surface.

Figure 1:
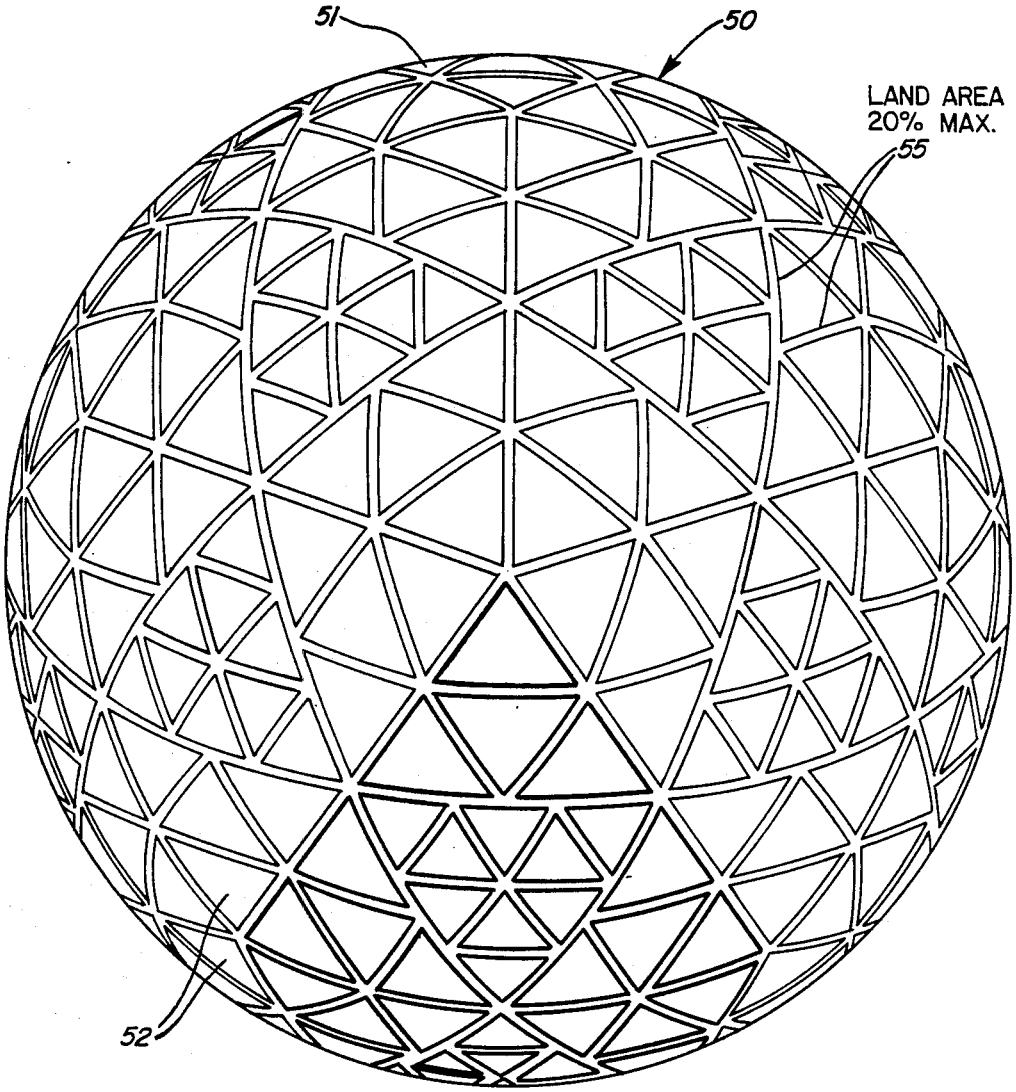
FIG. 1 is a view of one embodiment of a golf ball with triangular dimples and a uniform land configuration.
Figure 2:
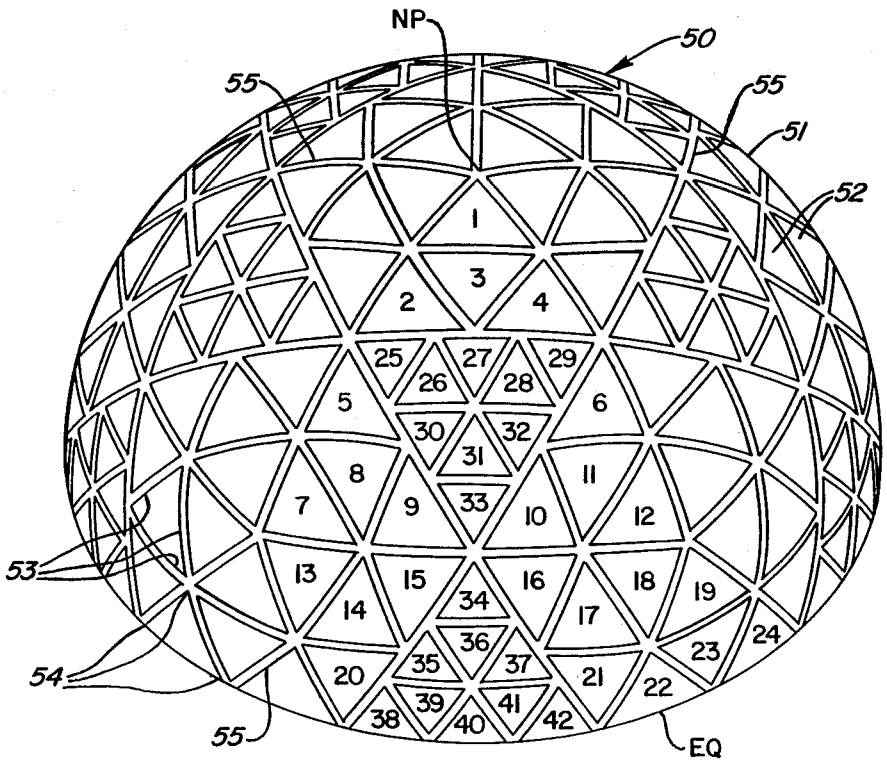
FIG. 2 is a perspective view of one hemisphere of the golf ball of FIG. 1.

FIG. 2 is a perspective view of one hemisphere or one-half of a golf ball 50. The top or North Pole of the ball is designated NP, and the equator is designated EQ. The bottom half of the ball is not shown but is identical to the top half.

In the embodiment illustrated the dimples are spherical triangles. Each of the dimples have three sides 53 which curve over the outer surface of the ball and which intersect at vertices 54. Planes which extend through sides of adjacent dimples are parallel to each other. When projected onto a planar surface, the triangular dimples have three straight sides which extend parallel to sides of adjacent dimples.

The lands between the dimples are elongated bands 55 which intersect adjacent to the vertices of the triangles. The width of the lands is constant between the parallel sides of adjacent dimples. The width of the lands is somewhat greater where the lands intersect at the vertices of the triangles so that the land width is not constant over the entire outer surface of the ball. However, the land width is constant except at the intersections so that the width is substantially constant over the entire outer surface.

Figure 4:
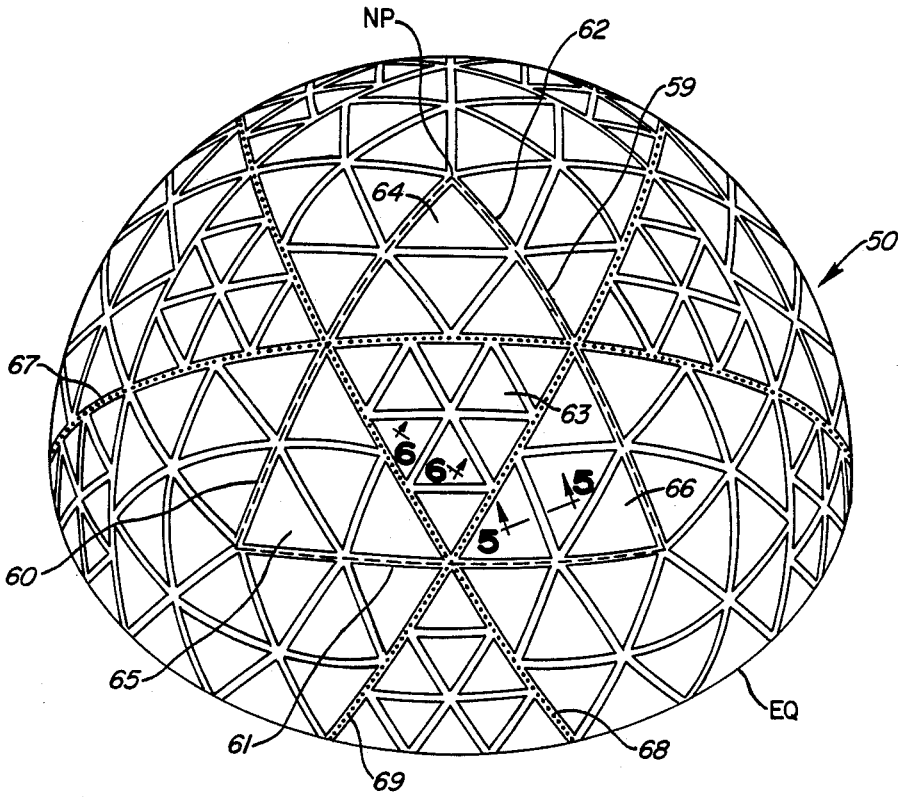
FIG. 4 is a view similar to FIG. 2.

The golf ball illustrated in the drawing has 420 dimples. The layout of the dimples follows the procedure described in U.S. Pat. No. 4,560,168, which is incorporated herein by reference. As described in said patent, the surface of the ball is divided into 20 spherical triangles 59 (FIG. 4) which correspond to the faces of a regular icosahedron. One of the icosahedral triangles 59 is indicated in FIG. 4 by the dashed lines 60 through 62. Each of the icosahedral triangles is divided into four smaller triangles—a central triangle 63 and three apical triangles 64, 65, and 66—by three great circles indicated by the dotted lines 67, 68, and 69. The great circles extend through the midpoints of the sides of the icosahedral triangle 59. The ball includes six great circles for the 20 icosahedral triangles.

Each of the apical triangles 64–66 is formed by one of the apexes of the icosahedral triangle 59. The apical triangle 64 includes four triangular dimples 1 through 4 (see FIG. 2); the apical triangle 65 includes four triangular dimples 5, 7, 8, and 9; the apical triangle 66 includes four triangular dimples 6, 10, 11, and 12; and the central triangle 63 includes nine triangular dimples 25 through 33. None of the dimples intersects the great circles, and a continuous land follows the path of each of the great circles.

The arrangement of the other dimples is determined with respect to the North Pole and the extensions of the sides 60 and 62 of the icosahedral triangle 59. Dimples 13 through 24 and 34 through 42 lie generally within the area bounded by the extensions of the lines 60 and 62. The location of each dimple is defined in the table which is part of FIG. 2. The dimple pattern repeats at 72 degree intervals around the North Pole. The dimple pattern on the bottom half of the golf ball, which is not shown in FIG. 2, is the same as the dimple pattern on the top half of the golf ball. The table which is part of FIG. 2 lists the dimple type, the vertical angle, the horizontal angle, and the rotational angle for each of the dimples 1–42.

Figure 3:
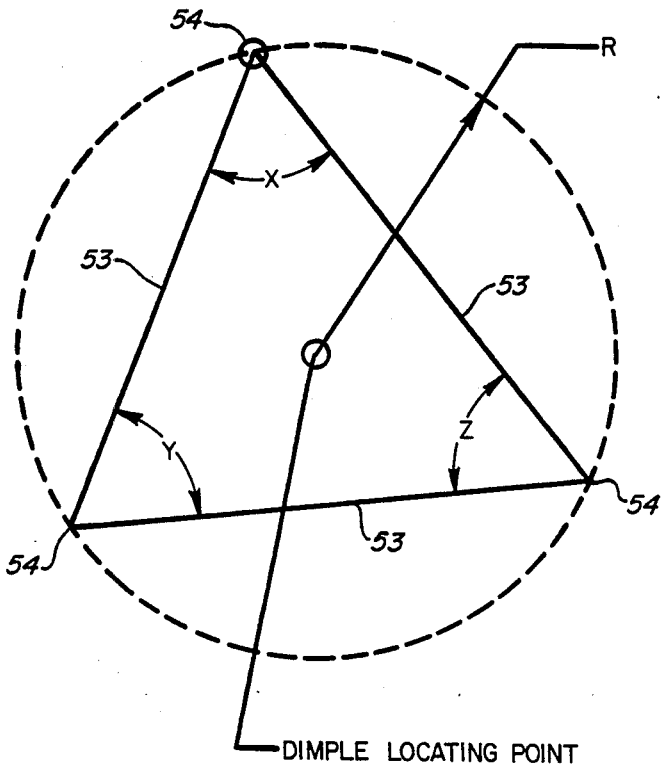
FIG. 3 illustrates a planar projection of the dimples which describes the size and shape of the dimples.

There are five types of dimples as indicated in FIG. 3: C, −C, D, E, and F. The dimple type is defined by the radius R of the circle which circumscribes the triangular periphery of the dimple and the three vertex angles X, Y and Z. The locating point of the dimple is the center of the circumscribed circle.

Referring again to FIG. 2, the term "Vert ∠" (Vertical Angle) represents the latitude of the locating point of the dimple, i.e., the Angle of the locating point from the equator. The Vertical Angle is the angle between a radius from the center of the ball to the equator and a radius from the center of the ball to the locating point. The Vertical Angle of a locating point on the equator would be zero, and the Vertical Angle of a locating point on the North Pole would be 90°.

The Horizontal Angle is equivalent to longitude, i.e., the angle around the equator between the extension of the side 60 of the icosahedral triangle 59 and a line which extends from the North Pole through the locating point of the dimple.

The Rotational Angle determines the location of the X vertex of the triangle (see FIG. 3) with respect to the North Pole. The Rotational Angle is the angle obtained by projecting a line from the locating point of the triangle to the X vertex and a line from the locating point to the North Pole onto the plane which contains the vertices of the dimple. A positive angle indicates that the first line is rotated counterclockwise from the second line. A negative angle indicates that the first line is rotated clockwise from the second line.

FIG. 3 illustrates that the five types of dimples are roughly equilateral triangles but not exactly. The angles of the vertices are selected so that triangles fit within the pattern established by the icosahedral triangles 59 and the great circles and so that the width of the land areas which surround each dimple is constant over the entire surface of the ball.

The dimples 25–33 which are located within the central triangle 63 are smaller than the dimples which are located within the remainder of the icosahedral triangle 59. The dimples 25–33 are Type E or F dimples, and, referring to FIG. 3, the circumscribed circle of each of the dimples 25–33 has a radius R of 0.0846 or 0.0882 inch. The dimples 1–12 in the remainder of the icosahedral triangle are Type C, −C, or D dimples. The circumscribed circle of each of the dimples 1–12 has a radius R of 0.1238 or 0.1291 inch. The golf ball is the conventional American size ball, and the outer diameter of the spherical surface is 1.68 inch. There are 21 dimples within each icosahedral triangle, or a total of 420 dimples on the ball.

Figure 5:
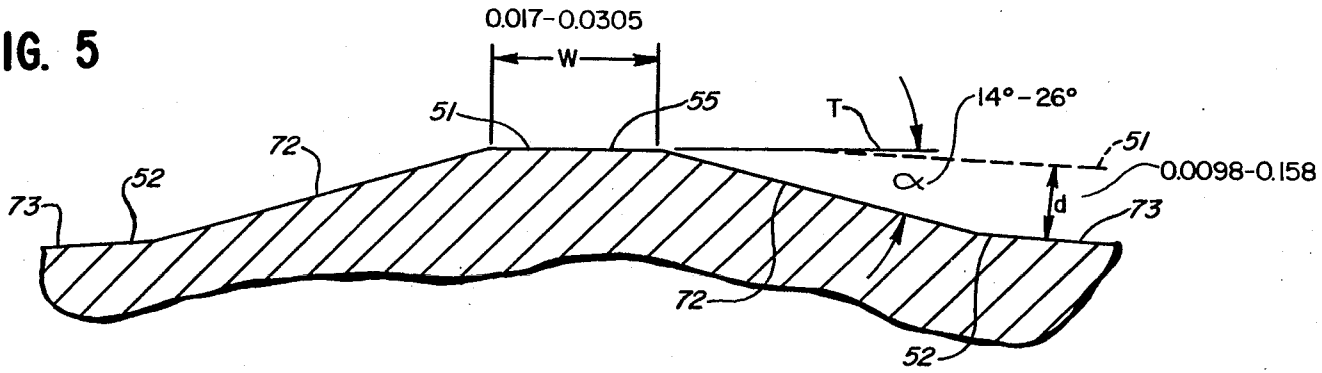
FIG. 5 is a fragmentary cross sectional view taken along the line 5—5 of FIG. 4.
Figure 6:
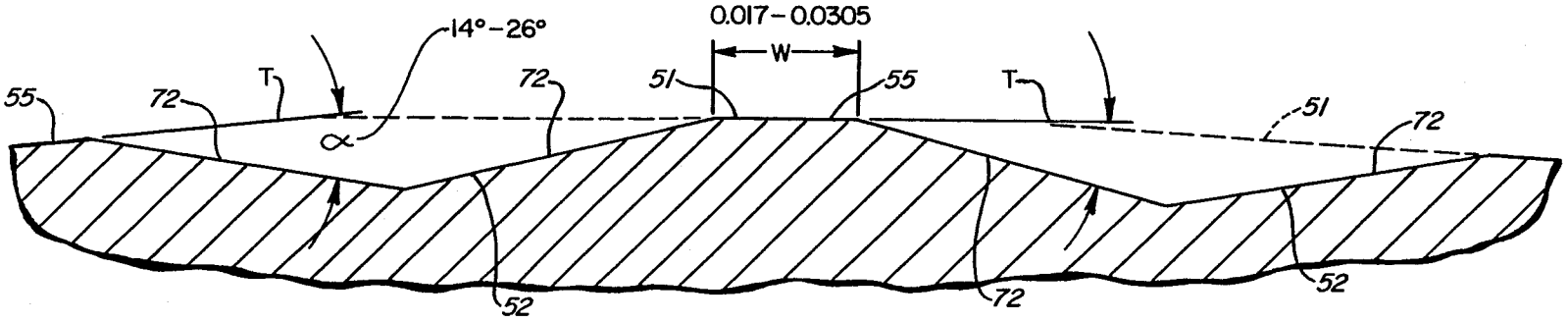
FIG. 6 is a fragmentary cross sectional view taken along the line 6—6 of FIG. 4.
Figure 7:
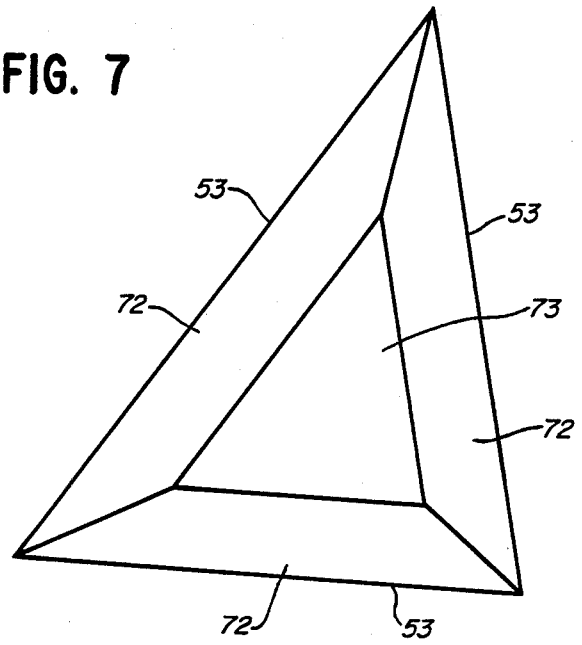
FIG. 7 is a planar projection of one of the larger dimples.
Figure 8:
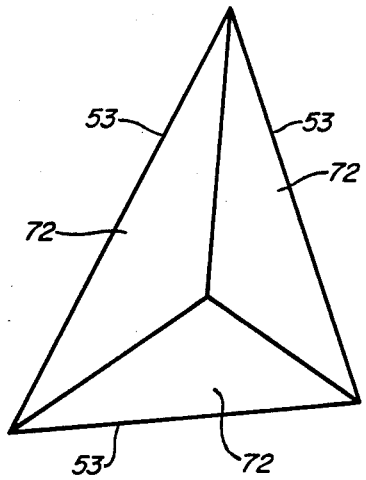
FIG. 8 is a planar projection of one of the smaller dimples.

FIGS. 5 and 6 illustrate the cross section of the land areas 55 and the dimples 52. FIG. 5 illustrates a cross section of the land area between two adjacent dimples of the larger type, Type C or D, and FIG. 6 illustrates the cross sectional configuration of the land area between two adjacent dimples of the smaller type, Type E or F.

Each of the dimples includes three "flat" side surfaces 72 which extend downwardly from the spherical outer surface 51 at an angle $\alpha$ with respect to a tangent T at the intersection of the side surface and the spherical outer surface. Since each land 55 is bounded by flat surfaces on both sides, the cross section of the land is constant along the entire length of the side of the dimple. The cross section of the land increases slightly where lands intersect at a vertex of a dimple, but otherwise the cross section is constant throughout the entire surface of the ball so that the cross section is substantially constant over the entire surface. The angle $\alpha$ is 15°, and the width w of each land is 0.017 inch.

Figure 11:
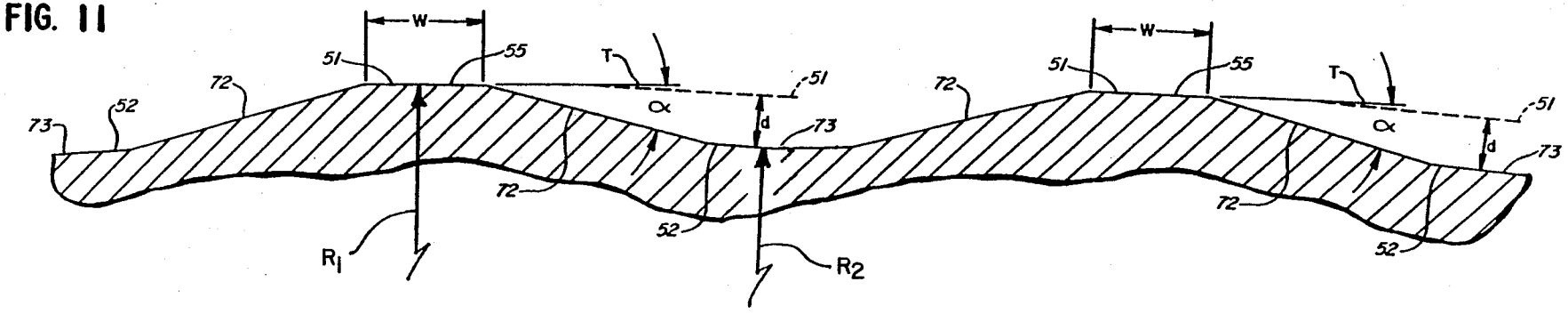
FIG. 11 is a fragmentary cross sectional view similar to FIG. 5.

Referring to FIG. 5, each of the relatively large dimples 1–12 has a convex bottom surface 73. The convex bottom surface is a portion of a sphere having a radius $R_2$ (FIG. 11) which is centered at the center of the ball, and the spherical surface 73 is concentric with the spherical outer surface 51 having a radius $R_1$. Forming the bottom surface of the dimples as a portion of a sphere is consistent with visualizing the land areas as projections from a spherical surface. The depth d of each of the large dimples is 0.010 inch. The depth is measured as the radial distance between the spherical surfaces 73 and 51.

Referring to FIG. 6, each of the smaller dimples 25–33 also includes three flat side surfaces 72 which extend at an angle $\alpha$ from a tangent T to the outer surfaces. However, the flat surfaces 72 of the smaller triangles intersect at a point, and the smaller triangles do not have a convex bottom surface. The depth d of the smaller triangle is determined by the intersecting point of the three sides.

The outer sphere which circumscribes the ball 50 has 20% land area and 80% dimple area. The percent of land area is calculated by adding the areas of individual lands 55. The overlap land area which is created by intersections of lands is disregarded in this calculation for convenience, and the actual land area is slightly less than 20% of the area of the sphere.

Figure 9:
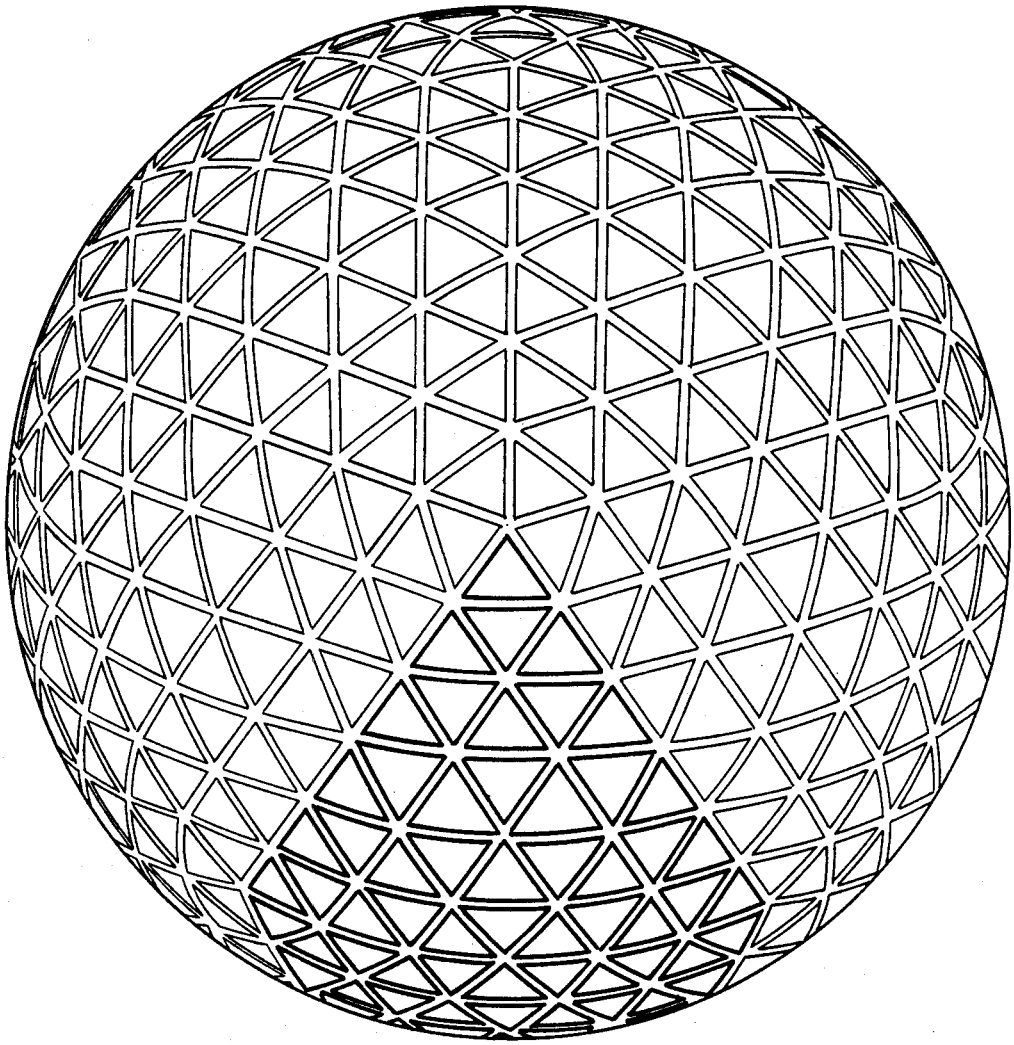
FIGS. 9 and 10 are views of other embodiments of a golf ball with triangular dimples and a uniform land configuration.

A ball with 720 triangular dimples can be made by filling the entire icosahedral triangle 59 with dimples similar to the smaller dimples 25–33 as shown in FIG. 9. Each of the apical portions 64–66 and the central portion 63 of each icosahedral triangle is filled with nine smaller dimples. Each of the 20 icosahedral triangles includes 36 dimples for a total of 720 dimples. The dimples would have a cross section as shown in FIG. 6. Each dimples would have three flat surfaces which extend at an angle of 15° from the tangent T, and the flat surfaces would intersect at a point at the bottom of the dimple. The width and cross section of the lands would be constant except where lands intersect at the vertices of the dimples.

Figure 10:
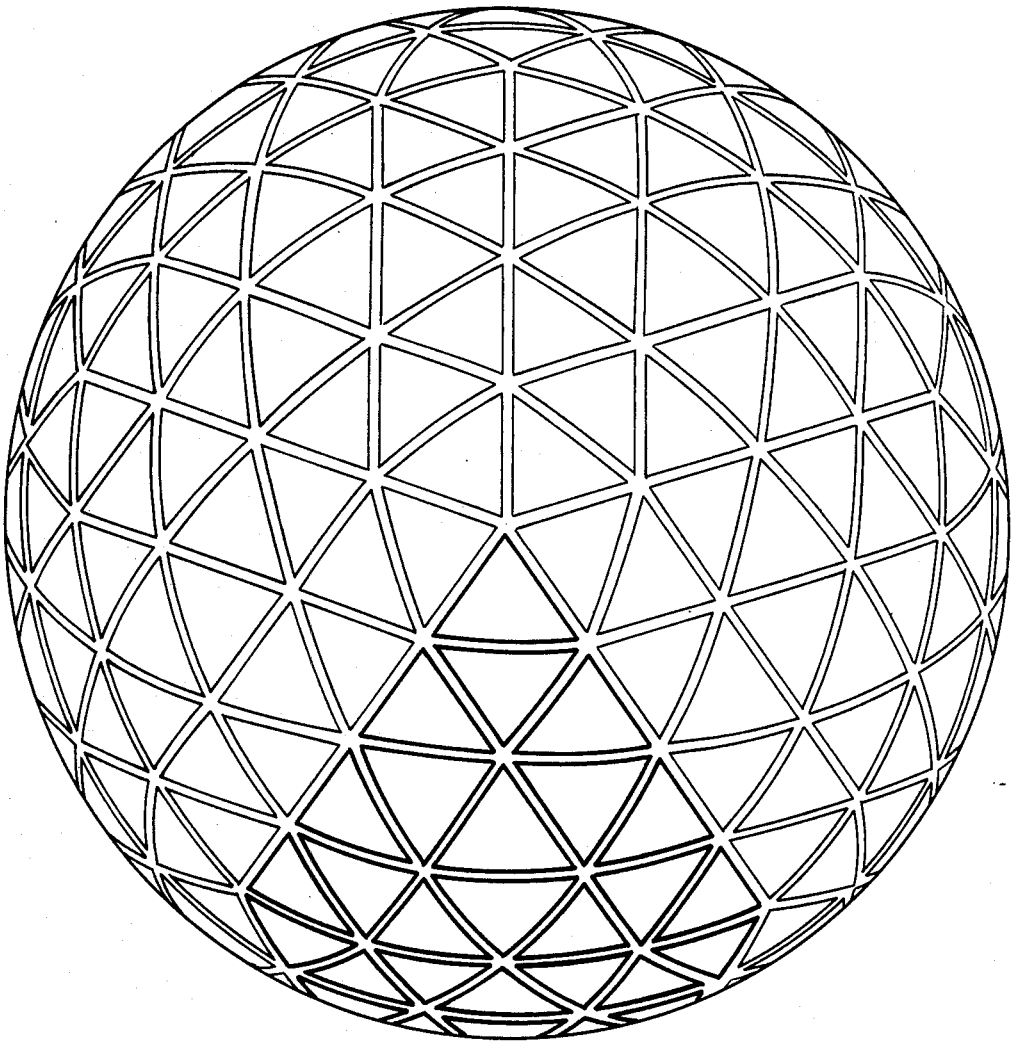

FIG. 10 illustrates an early embodiment of a ball with uniform land configuration which included 320 triangular dimples. Each dimple included three "flat" side surfaces which extended at an angle of 16.65° to a tangent at the outer spherical surface. The bottom surface of each dimple was spherical, and the depth of the dimple was a relatively shallow 0.0048 inch. The width of the lands was 0.0305 inch. The ball was manufactured in the same manner as a control ball, which was a commercial three-piece Wilson Staff Surlyn-covered ball. The Wilson Staff control ball included 432 circular dimples arranged in accordance with U.S. Pat. No. 4,560,168. Play tests of the ball indicated that the trajectory of the ball was higher and shorter than the trajectory of the control ball. It is believed that the higher trajectory of the ball was due to insufficient turbulence caused by the shallow dimples.

Five other embodiments or iterations of the 320 dimple ball were made and tested. The relationship between the six iterations of the 320 dimple ball can be seem from the following table:

TABLE I

| Iteration Number | Dimple Depth (inch) | Land Width (inch) | Wall Angle | Carry Distance (yards) | Total Distance (yards) | Apogee Angle |
|---|---|---|---|---|---|---|
| 1 | .0048 | .0305 | 16.65° | −19.1 | −23.7 | +2.7° |
| 2 | .0098 | .0300 | 17.80 | −8.2 | −12.1 | +1.6 |
| 3 | .0135 | .0374 | 18.60 | −7.7 | −11.2 | +1.9 |
| 4 | .0158 | .0227 | 19.00 | −9.4 | −10.7 | +0.9 |
| 5 | .0142 | .0259 | 26.85 | −32.9 | −3.0 | −1.0 |
| 6 | .0101 | .0238 | 17.08 | −5.8 | −8.2 | +1.3 |

The wall angle is the angle between the three "flat" side surfaces of the dimple and a tangent to the outer spherical surface where the flat surface intersects the spherical surface. The carry distance, total distance, and apogee angle are compared to the Wilson Staff control ball.

The balls of the first six embodiments were provided with uniform land configurations. However, it is believed that the balls did not perform as well as the control ball because the dimple pattern provided a non-optimal relationship between lift and drag. A greater number of smaller dimples should improve that relationship and allow the ball to fly as well as or better than the control ball. It is believed that the embodiment shown in FIGS. 1–8 accomplishes that objective.

If a ball is to have uniform land configuration, the shape of the dimples must be polygonal. Although shapes other than triangles could be used, triangular dimples are preferred because triangular dimples are easier to make and because a triangle has fewer vertices than any other polygon. As described previously, the width and cross section of the lands is not constant at the vertices of the polygon, and the land areas therefore do not entirely comply with the objective of uniform land configuration at the vertices. The use of triangular dimples minimizes the number of locations at which the land areas are not exactly uniform.

Conventional circular dimples have a spherical side surface below the spherical outer surface of the ball, and the spherical side surface is generally continuous so that the bottom of the dimple is also spherical in a concave direction. The Wilson Pro Staff ball had dimples in the shape of a truncated cone, and the bottom surface of the dimple was flat. The side of the cone extended at an angle of 14° to the chord line of the dimple, i.e., a line which extends from edge to edge across the dimple. While dimples having triangular peripheries in accordance with the invention could be provided with side surfaces having other shapes than the side surfaces described herein, the use of "flat" side surfaces is preferred because that enables the wall angles $\alpha$ to be changed independently of the depth of the dimple and enables the ball to approach more closely the objective of having uniform land cross section throughout the ball. A spherical side surface is also more difficult to make for a dimple which has a triangular or polygonal periphery.

The preferred method of arranging the triangular dimples follows the teaching of U.S. Pat. No. 4,560,168 in which dimples do not intersect the six great circles. This provides an easy method for arranging the triangular dimples and provides a ball with many axes of symmetry. However, it is not essential to use the procedure described in U.S. Pat. No. 4,560,168, and other arrangements of polygonal dimples can be used which provide uniform land configuration.

The molded cover of a conventional golf ball has a parting line when the ball is removed from the mold. As described in U.S. Pat. No. 4,560,168, the parting line is advantageously designed to lie on one of the lands which follow the great circles which help to define the dimple pattern. After the ball is removed from the mold, the parting line or seam line is buffed to smooth the parting line. The land along which the parting line is formed needs to have some minimum width in order to withstand the buffing operation. This minimum width provides some practical limitation on how narrow the lands can be made. However, if a ball is manufactured by a procedure which does not require buffing the parting line, it would be possible to utilize a narrower land configuration and a greater dimple area.

The dimensions of the balls described herein are for the conventional American size ball which has a diameter of 1.68 inch. It will be understood, however, that the invention may also be used on the British size ball or on any other suitably sized golf ball.

While in the foregoing specification detailed descriptions of specific embodiments of the invention were set forth for the purpose of illustration, it will be understood that many of the details herein given may be varied considerably by those skilled in the art without departing from the spirit and scope of the invention.

I claim:

1. A golf ball having an outer spherical surface and at least 320 dimples formed in the outer surface to provide land areas on the outer surface which surround the dimples, each of the dimples having a triangular periphery at said outer surface provided by three sides and three flat surfaces which extend inwardly from the outer surface, the angle between each of the flat surfaces and a tangent to the outer surface at the intersection with the flat surface being from 14° to 26°, each side of each dimple extending parallel to at least a portion of the side of an adjacent dimple, the distance between the parallel sides of adjacent dimples being constant over the outer spherical surface, the total land area being no greater than 20% of a sphere which circumscribes said outer spherical surface.

2. The golf ball of claim 1 in which at least some of the dimples have a convex bottom surface which is a portion of a sphere.

3. The golf ball of claim 2 in which the spherical surface of each of said convex bottom surfaces is concentric with the outer spherical surface.

4. The golf ball of claim 1 in which the angle between each of the flat surfaces and a tangent to the outer surface at the intersection with the flat surface is 15°.

5. The golf ball of claim 1 in which the distance between the parallel sides of adjacent dimples is between 0.017 and 0.0305 inch.

* * * * *